US005936647A

United States Patent [19]

Rhodes et al.

[11] Patent Number: 5,936,647

[45] Date of Patent: Aug. 10, 1999

[54] FLEXIBLE FRAME ONSERT CAPPING OF INKJET PRINTHEADS

[75] Inventors: John D. Rhodes, Vancouver, Wash.; Donald L. Michael, Monmouth, Oreg.

[73] Assignee: Hewlett-Packard Company, Palo Alto, Calif.

[21] Appl. No.: 08/741,850

[22] Filed: Oct. 31, 1996

[51] Int. Cl.[6] ..... B41J 2/165

[52] U.S. Cl. ..... 347/29; 347/24

[58] Field of Search ..... 342/29, 30, 31, 342/32, 22, 24; 347/22, 24, 29, 30

[56] References Cited

U.S. PATENT DOCUMENTS

| | | | |
|---|---|---|---|
| 4,683,481 | 7/1987 | Johnson . | |
| 4,853,717 | 8/1989 | Harmon et al. . | |
| 5,027,134 | 6/1991 | Harmon et al. . | |
| 5,086,305 | 2/1992 | Terasawa | 347/29 |
| 5,103,244 | 4/1992 | Gast et al. . | |
| 5,115,250 | 5/1992 | Harmon et al. . | |
| 5,146,243 | 9/1992 | English et al. . | |
| 5,155,497 | 10/1992 | Martin et al. . | |
| 5,216,449 | 6/1993 | English . | |
| 5,252,993 | 10/1993 | Tomii et al. | 346/140 |
| 5,278,584 | 1/1994 | Keefe et al. . | |
| 5,394,178 | 2/1995 | Grange | 347/32 |
| 5,440,331 | 8/1995 | Grange | 347/32 |
| 5,448,270 | 9/1995 | Osborne | 347/29 |
| 5,455,609 | 10/1995 | Gast et al. | 347/32 |
| 5,517,220 | 5/1996 | English | 347/29 |
| 5,563,638 | 10/1996 | Osborne | 347/32 |
| 5,682,186 | 10/1997 | Bohorquez et al. | 347/29 |

*Primary Examiner*—N. Le
*Assistant Examiner*—Thien Tran
*Attorney, Agent, or Firm*—Flory L. Martin

[57] ABSTRACT

A flexible frame onsert molded capping system has an elastomeric sealing lip onsert molded onto a flexible, flat, springy support frame, preferably with series of these sealing lips being molded on a single flexible frame to simultaneously seal several adjacent inkjet printheads. The frame has a border region with one or more cap bases attached to the frame by plural suspension spring elements. The suspension spring elements have both cantilever and torsional characteristics which allow the bases to tilt and twist independent of one another to seal each printhead, even when the orifice plates of adjacent printheads are not in a coplanar alignment. Use of a single piece frame, and onsert molding of the cap lips thereon, decreases the number of parts required to assemble an inkjet printing mechanism, leading to a more economical unit which is easier to assemble.

65 Claims, 7 Drawing Sheets

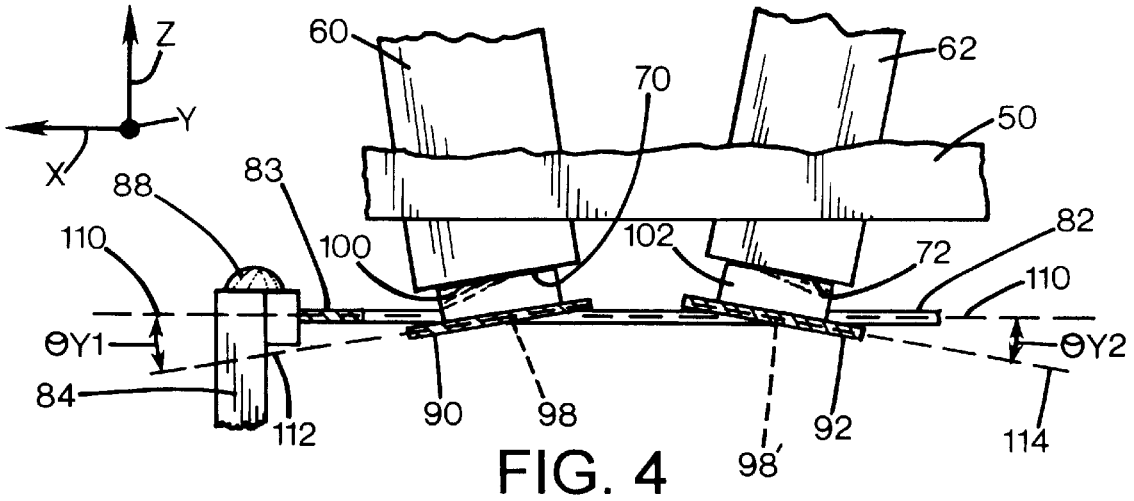
FIG. 4
FIG. 5
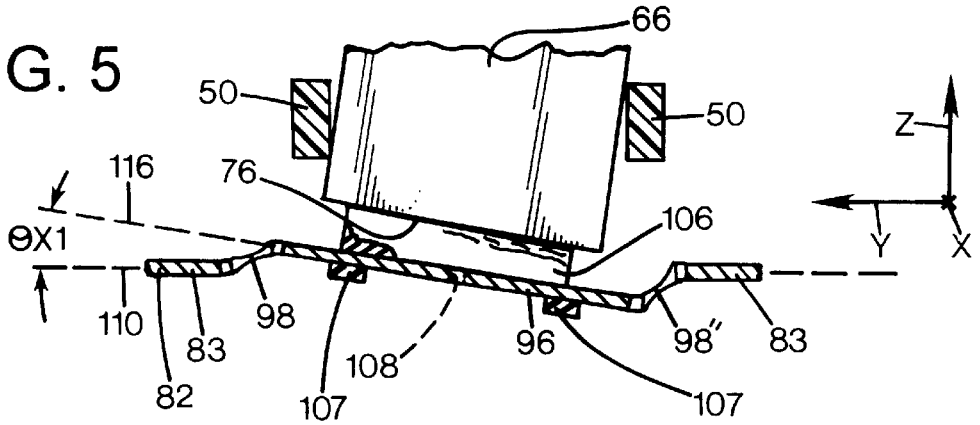
FIG. 6
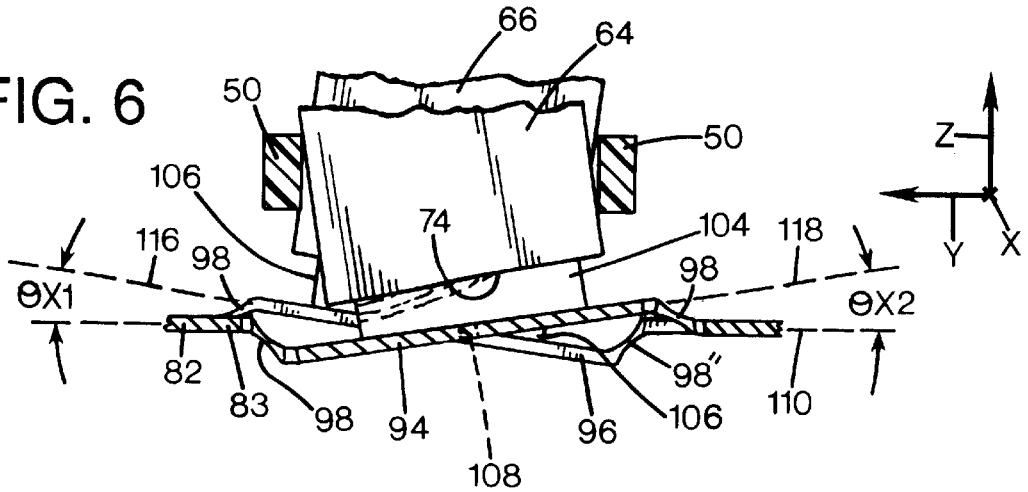

FLEXIBLE FRAME ONSERT CAPPING OF INKJET PRINTHEADS

FIELD OF THE INVENTION

The present invention relates generally to inkjet printing mechanisms, and more particularly to a flexible capping system having an elastomeric sealing member onsert molded onto a flexible, flat, springy support frame, and preferably to a series of such sealing members mounted on a single flexible frame to simultaneously seal several adjacent inkjet printheads.

BACKGROUND OF THE INVENTION

Inkjet printing mechanisms use cartridges, often called "pens," which eject drops of liquid colorant, referred to generally herein as "ink," onto a page. Each pen has a printhead formed with very small nozzles through which the ink drops are fired. To print an image, the printhead is propelled back and forth across the page, ejecting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved through relative motion of the printhead and wiper, for instance by moving the printhead across the wiper, by moving the wiper across the printhead, or by moving both the printhead and the wiper.

To improve the clarity and contrast of the printed image, recent research has focused on improving the ink itself. To provide quicker, more waterfast printing with darker blacks and more vivid colors, pigment-based inks have been developed. These pigment-based inks have a higher solid content than the earlier dye-based inks, which results in a higher optical density for the new inks. Both types of ink dry quickly, which allows inkjet printing mechanisms to form high quality images on readily available and economical plain paper.

Early inkjet printers used a single monochromatic pen, typically carrying black ink. Later generations of inkjet printing mechanisms used a black pen which was interchangeable with a tri-color pen, typically one carrying the colors of cyan, magenta and yellow within a single cartridge. Here, the service station was designed to service either type of cartridge.

The next generation of printers further enhanced the images by using either a dual pen system or a quad pen system. The dual pen printers provided a black pen along with a tri-color pen, both of which were mounted in a single carriage. Here, the service stations had caps arranged side-by-side to simultaneously seal both the black and tri-color printheads. These dual pen devices had the ability to print crisp, clear black text while providing full color images. The quad pen printing mechanisms had a first pen carrying black ink, a second pen carrying cyan ink, a third pen carrying magenta ink, and a fourth pen carrying yellow ink. Quad pen plotters typically carried four cartridges in four separate carriages, so each cartridge needed individual servicing. Quad pen desktop printers were designed to carry four cartridges in a single carriage, so all four cartridges could be serviced by a single service station.

These earlier dual and quad pen printers required an elaborate capping mechanism to hermetically seal each of the printheads during periods of inactivity. A variety of different mechanisms have been used to move the servicing implements into engagement with respective printheads. For example, a dual printhead servicing mechanism which moves the caps in a perpendicular direction toward the orifice plates of the printheads is shown in U.S. Pat. No. 5,155,497, assigned to the present assignee, Hewlett-Packard Company, of Palo Alto, Calif. Another dual printhead servicing mechanism uses the carriage to pull the caps laterally up a ramp and into contact with the printheads, as shown in U.S. Pat. No. 5,440,331, also assigned to the Hewlett-Packard Company. A rotary device for capping dual inkjet printheads is commercially available in several models of printers produced by the Hewlett-Packard Company of Palo Alto, Calif., including the DeskJet® 850C, 855C, 820C and 870C model printers. Examples of a quad pen capping system that use a translation motion are seen in several other commercially available printers produced by the Hewlett-Packard Company, including the DeskJet® 1200 and 1600 models. Thus, a variety of different mechanisms and angles of approach may be used to physically move the caps into engagement with the printheads.

The caps in these earlier service station mechanisms typically included an elastomeric sealing lip supported by a movable platform or sled. This sled was typically produced using high temperature thermoplastic materials or thermoset plastic materials which allowed the elastomeric lips to be onsert molded onto the sled. The elastomeric sealing lips were sometimes joined at their base to form a cup-like structure, whereas other cap lip designs projected upwardly from the sled, with the sled itself forming the bottom of the sealing cavity. Typically, provisions were made for venting the sealing cavity as the cap lips are brought into contact with the printhead. Without a venting feature, air could be forced into the printhead nozzles during capping, which could deprime the nozzles.

Capping systems need to provide an adequate seal while accommodating a several different types of variations in the printhead. For example, today's orifice plates often each have a waviness. Commercially available orifice plates are not perfectly planar, but they may be slightly bowed in a convex, concave or compound (both convex and concave)

configuration. This waviness may generate a height variation of up to 0.05–0.08 millimeters (2–3 mils; 0.002–0.003 inches). These orifice plates may also have some inherent surface roughness over which the cap must seal. The typical way of coping with both the waviness problem and the surface roughness problem is through elastomer compliance, where a soft material is used for the cap lips. The soft cap lips compress and conform to seal over these irregularities in the orifice plate.

Another feature shared by the earlier capping systems is the ability to accommodate planar misalignments between the orifice plates of cartridges installed in a printing mechanism. Due to various manufacturing tolerances associated with the pen carriage and the pens themselves, as well as minor variations in the placement of the cartridges within the carriage, the sealing surfaces of adjacent orifice plates may not lie the same plane. Indeed, the planes defined by these orifice plates may lie at a variety of different angles with respect to one another. Moreover, the sealing surface of an individual pen may not lie in a single plane. Thus, a capping system must be able to accommodate these different types of irregularities. Minor irregularities are accommodated by the elastomeric nature of the sealing lips, which allows the lips of a single cap to be compressed more in one area than in another.

These planar misalignments, where the orifice plates are at different heights and/or tilted with respect to a reference plane, were traditionally addressed by using elaborate mechanisms. Typically these mechanisms had spring-loaded cap sleds to accommodate for the height variation, with the sleds also having a gimbaling feature so they could tilt to seal a tilted orifice plate. Some of the later service stations, such as the rotary capping device commercially available in the DeskJet® 850C, 855C, 820C and 870C model printers produced by the Hewlett-Packard Company, use a coiled spring underneath the capping sled, with the spring being compressed when the printheads are capped. Other mechanisms have mounted the printhead caps on separate arms, for example, as commercially available in the DeskJet 660C model color inkjet printer sold by the Hewlett-Packard Company. Each arm has one end pivotally attached to the frame, with a cap base pivotally attached to the other end of the arm. Each arm is biased toward the printhead by a spring which is compressed during capping. Unfortunately, such earlier spring mechanisms for accommodating printhead-to-printhead planar misalignments were often elaborate and required many different parts to be assembled into the final capping unit. These additional parts increased the overall cost of the inkjet printer, not only in material costs, but also in labor costs required for assembly.

Another shortfall of the earlier multi-pen capping systems was the physical width required to place each cap side-by-side on the capping sled. For example, when onsert molding the cap lips to a plastic sled, the base of each cap lip was fit over a race track which projected upwardly from the sled. A series of attachment holes through the sled were located around the race track for the elastomeric material to seep through during the onsert molding process, which then secured the lip to the sled upon curing. Thus, a region on the sled was dedicated to the race and attachment holes, increasing the overall width of the sled. In the past, sled width was not a problem because the inkjet cartridges were replaceable and they each carried a significant supply of ink. The overall width of these replaceable pens often ranged from 2 to 3.5 centimeters. Thus, the cartridges themselves, when installed in a carriage, were far wider than the width required to place caps side-by-side on a sled.

As the inkjet industry investigates new printhead designs, the tendency is toward using permanent or semi-permanent printheads in what is known in the industry as an "off-axis" printer. In an off-axis system, the printheads carry only a small ink supply across the printzone, with this supply being replenished through tubing that delivers ink from an "off-axis" stationary reservoir placed at a remote stationary location within the printer. Since these permanent or semi-permanent printheads carry only a small ink supply, they may be physically more narrow than their predecessors, the replaceable cartridges.

Narrower printheads lead to a narrower printing mechanism, which has a smaller "footprint," so less desktop space is needed to house the printing mechanism during use. Narrower printheads are usually smaller and lighter, so smaller carriages, bearings, and drive motors may be used, leading to a more economical printing unit for consumers. Thus, there are a variety of advantages associated with these off-axis printing systems.

Indeed, in the extreme case, each of the nozzle sets (for black, cyan, magenta and yellow inks, for instance) may eventually be manufactured on a single piece of silicon substrate, with printhead sealing accomplished by a single cap. Such a simple capping system clearly would not suffer the problems encountered when trying to seal several small discrete off-axis pens, each having their own silicon substrate printhead and the associated misalignment problems discussed above. Thus, the challenge becomes one of how to adequately cap several closely spaced discrete semi-permanent printheads. Proper capping requires providing an adequate hermetic seal without applying excessive force which may damage the delicate printheads or unseat the pens from their locating datums in the carriage. Moreover, it would be desirable to provide such a capping system which is more economical to manufacture than earlier capping systems. Such economies may be realized by requiring fewer parts for the capping system. It would also be desirable for such an improved capping system to be readily adaptable to the earlier mechanisms for moving caps in contact with the printheads.

SUMMARY OF THE INVENTION

According to one aspect of the present invention, a capping system is provided for sealing ink-ejecting nozzles of an inkjet printhead in an inkjet printing mechanism. The capping system includes a flexible frame that is moveable between a rest position and a sealing position. The flexible frame has a border portion, a cap base portion and a spring portion that couples the base portion to the border portion. The capping system also has a sealing lip that is onsert molded to the flexible frame cap base portion, with the sealing lip sized to surround and seal the printhead nozzles when the frame is in the sealing position. The frame border portion defines a reference plane, and the spring portion allows at least a fraction of the cap base portion to move out of the reference plane when the frame is in the sealing position. According to yet another aspect of the present invention, a capping system is provided for sealing ink-ejecting nozzles of an inkjet printhead in an inkjet printing mechanism. The capping system includes a substantially rigid frame border portion, a cap base portion, and a sealing lip supported by the cap base portion. The capping system also has a flexible web portion that couples the cap base portion to the frame border portion.

According to another aspect of the present invention, a method is provided for sealing ink-ejecting nozzles of plural inkjet printheads in an inkjet printing mechanism. The method includes the steps of providing a capping assembly comprising a flexible frame having a border portion that defines a reference plane, and plural cap bases each associated with a respective one of the plural inkjet printheads. The flexible frame also has suspension springs that couple each cap base to the border portion. Each cap base also supports a sealing lip sized to surround and seal the nozzles of the associated printhead. Through relative movement of the plural inkjet printheads and the capping assembly, in a contacting step each sealing lip is placed in contact with an associated printhead. During the contacting step, in a moving step, at least one of the plural cap bases is moved away from an orientation parallel with the reference plane.

According to an additional aspect of the present invention, a capping system is provided as including a flexible frame stamped from a metallic material to define a border portion, a cap base portion and a spring portion of the flexible frame. The spring portion of the flexible frame couples the base portion to the border portion. The capping system also has a sealing lip onsert molded to the flexible frame cap base portion. The sealing lip is sized to surround and seal the printhead nozzles. In an alternate embodiment, rather than a stamped frame, a capping system has a metallic flexible frame with plural voids laser-cut therethrough to define a border portion, a cap base portion and a spring portion of the flexible frame.

According to a further aspect of the present invention, an inkjet printing mechanism may be provided as including one of the capping systems described above.

An overall goal of the present invention is to provide an inkjet printing mechanism which prints sharp vivid images over the life of the pen and the printing mechanism, particularly when using fast drying pigment or dye-based inks, and preferably when dispensed from an off-axis system.

A further goal of the present invention is to provide a capping system for an inkjet printing mechanism that adequately seals the inkjet printheads, particularly if they are closely spaced to one another, whether on discrete separate substrates or on a single substrate, which provides an adequate hermetic seal to each printhead.

Another goal of the present invention is to provide a flexible capping system which is also easily recyclable, at the end of the useful life of the inkjet printer.

Still another goal of the present invention is to provide a flexible capping system that adequately seals inkjet printheads in an inkjet printing mechanism, with the capping system having fewer parts that are easier to manufacture than earlier systems, and which thus provides consumers with a reliable, economical inkjet printing unit.

BRIEF DESCRIPTION OF THE DRAWINGS

FIG. 4 is an enlarged, exaggerated front elevational, sectional view taken along line 4—4 of FIG. 3, shown sealing two laterally misaligned printheads using torsional features of the capping system.

FIG. 5 is an enlarged, exaggerated side elevational, sectional view taken along line 5—5 of FIG. 3, shown sealing a longitudinally misaligned printhead using cantilever features of the capping system.

FIG. 6 is an enlarged, exaggerated side elevational, sectional view taken along line 6—6 of FIG. 3, shown sealing two longitudinally misaligned printheads using cantilever features of the capping system.

DETAILED DESCRIPTION OF A PREFERRED EMBODIMENT

Figure 1:
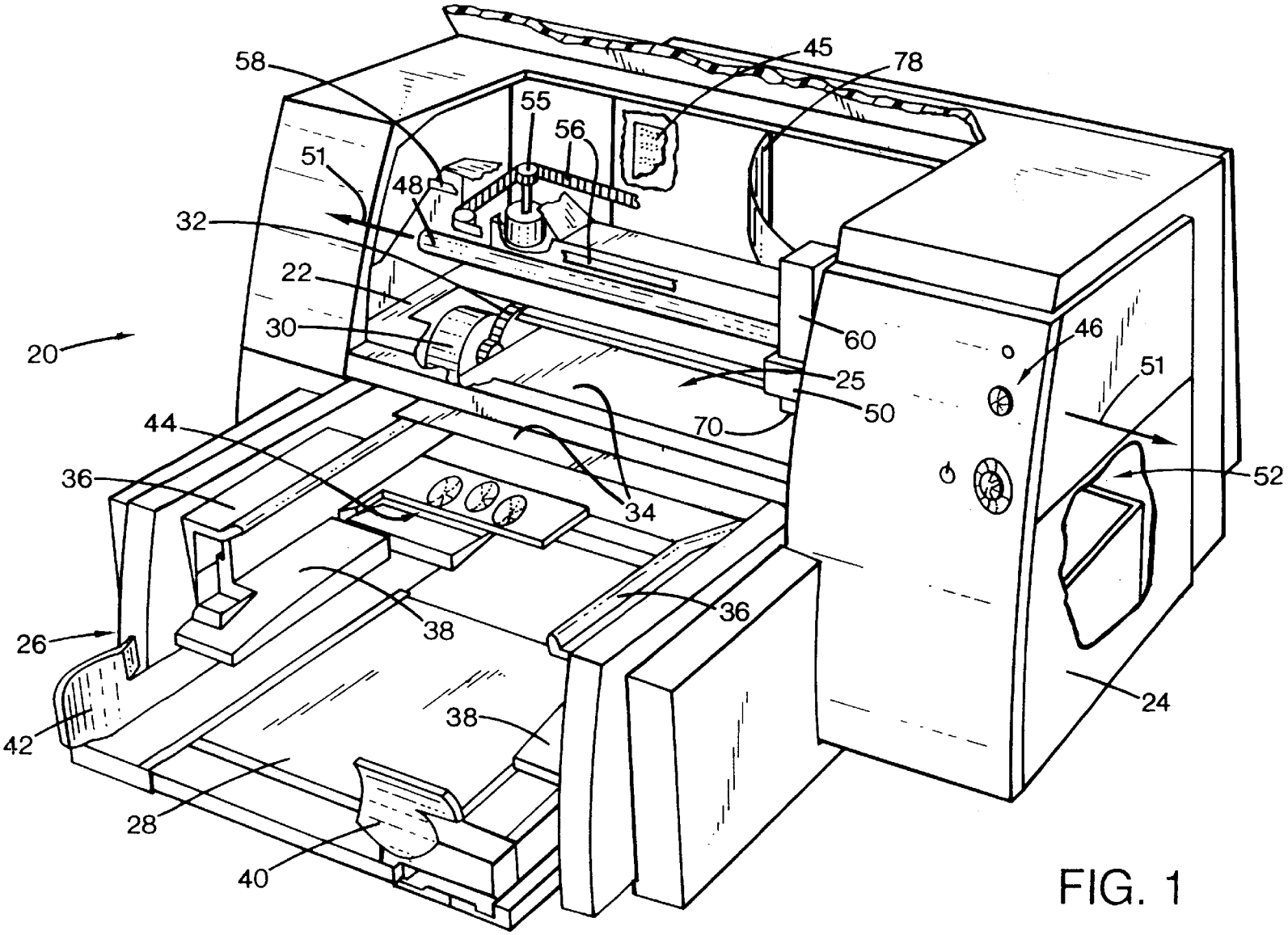
FIG. 1 is a perspective view of one form of an inkjet printing mechanism, here, an inkjet printer, including a printhead service station having one form of a flexible onsert molded capping system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a print zone 25 by a media handling system 26. The print media may be any type of suitable sheet material, such as paper, card-stock, transparencies, mylar, and the like, but for convenience, the illustrated embodiment is described using paper as the print medium. The media handling system 26 has a feed tray 28 for storing sheets of paper before printing. A series of conventional paper drive rollers (not shown), driven by a stepper motor and drive gear assembly 30, may be used to move the print media from tray 28 into the print zone 25, as shown for sheet 34, for printing. After printing, the motor 30 drives the printed sheet 34 onto a pair of retractable output drying wing members 36, shown in an extended position. The wings 36 momentarily hold the newly printed sheet above any previously printed sheets still drying in an output tray portion 38, then the wings 36 retract to the sides to drop the newly printed sheet into the output tray 38. The media handling system 26 may include a series of adjustment mechanisms for accommodating different sizes of print media, including letter, legal, A-4, envelopes, etc., such as a sliding length adjustment lever 40, a sliding width adjustment lever 42, and an envelope feed port 44.

The printer 20 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the chassis 22 to slideably support a quad inkjet pen carriage system 50 for travel back and forth across the print zone 25 along a scanning axis 51. The carriage 50 is also propelled along guide rod 48 into a servicing region, as indicated generally by arrow 52, located within the interior of the housing 24. A carriage drive gear and DC motor assembly 55 is coupled to drive an endless belt 56. The motor 55 operates in response to control signals received from the controller 45. The belt 56 may be secured in a conventional manner to the carriage 50 to incrementally advance the carriage 50 along guide rod 48 in response to rotation of motor 55.

To provide carriage positional feedback information to printer controller 45, an encoder strip 58 extends along the length of the print zone 25 and over the service station area 52. A conventional optical encoder reader may also be mounted on the back surface of printhead carriage 50 to read positional information provided by the encoder strip 58. The manner of attaching the belt 56 to the carriage, as well as the manner providing positional feedback information via the encoder strip reader, may be accomplished in a variety of different ways known to those skilled in the art.

Figure 2:
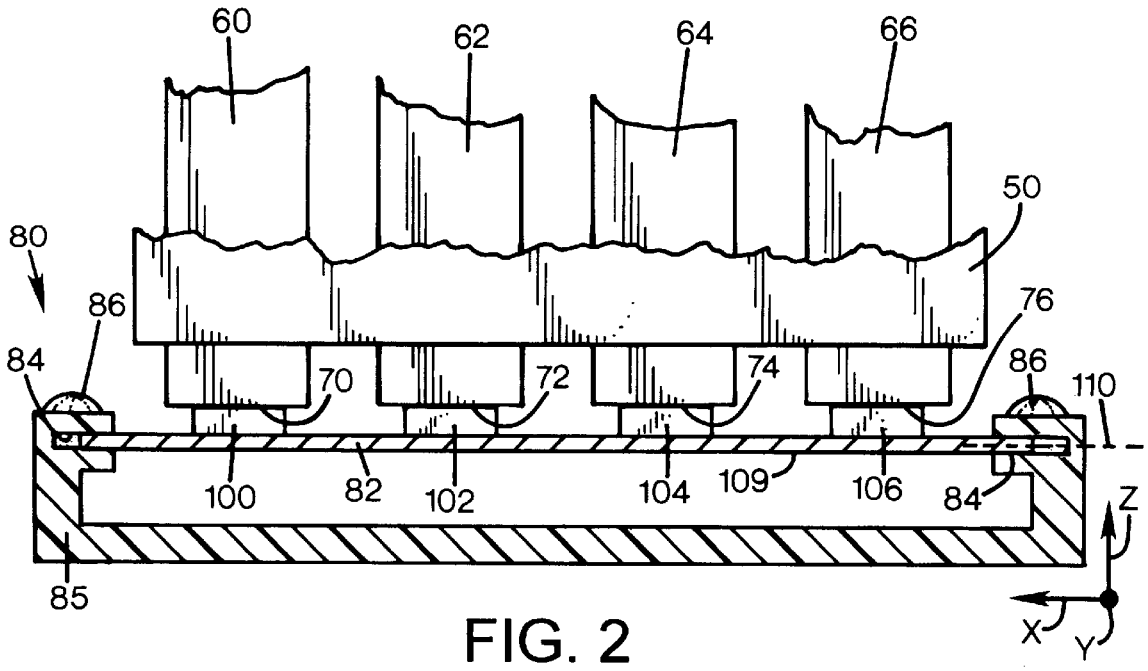
FIG. 2 is an enlarged front elevational sectional view of the capping assembly of FIG. 1, shown supported by a sled and sealing four discrete inkjet printheads mounted in a single carriage.

In the print zone 25, the media sheet 34 receives ink from an inkjet cartridge, such as a black ink cartridge 60 and three monochrome color ink cartridges 62, 64 and 66, shown schematically in FIG. 2. The cartridges 60–66 are also often called "pens" by those in the art. The black ink pen 60 is illustrated herein as containing a pigment-based ink. While the illustrated color pens 62–66 may contain pigment-based inks, for the purposes of illustration, pens 62–66 are described as each containing a dye-based ink of the colors cyan, yellow and magenta. It is apparent that other types of inks may also be used in pens 60–66, such as paraffin-based inks, as well as hybrid or composite inks having both dye and pigment characteristics.

The illustrated pens 60–66 each include reservoirs for storing a supply of ink therein. As mentioned in the Background section above, the reservoirs for each pen 60–66 may contain the entire ink supply on board the printer for each color, which is typical of a replaceable cartridge, or they may store only a small supply of ink in what is known as an "off-axis" ink delivery system. The replaceable cartridge systems carry the entire ink supply as the printhead reciprocates over the printzone 25 along the scanning axis 51. Hence, the replaceable cartridge system may be considered as an "on-axis" system, whereas systems which store the main ink supply at a stationary location remote from the printzone scanning axis are called "off-axis" systems. In an off-axis system, ink of each color for each printhead is delivered via a conduit or tubing system from the main stationary reservoirs to the on-board reservoirs adjacent to the printheads. The pens 60, 62, 64 and 66 have printheads 70, 72, 74 and 76, respectively, which selectively eject ink to from an image on a sheet of media in the printzone 25. The concepts disclosed herein for sealing the printheads 70–76 apply equally to the totally replaceable inkjet cartridges and to the off-axis semi-permanent or permanent printheads, although the greatest benefits of the inventors' capping system may be realized in an off-axis system.

The printheads 70, 72, 74 and 76 each have an orifice plate with a plurality of nozzles formed therethrough in a manner well known to those skilled in the art. The nozzles of each printhead 70–76 are typically formed in at least one, but typically two linear arrays along the orifice plate. Thus, the term "linear" as used herein may be interpreted as "nearly linear" or substantially linear, and may include nozzle arrangements slightly offset from one another, for example, in a zigzag arrangement. Each linear array is typically aligned in a longitudinal direction perpendicular to the scanning axis 51, with the length of each array determining the maximum image swath for a single pass of the printhead. The illustrated printheads 70–76 are thermal inkjet printheads, although other types of printheads may be used, such as piezoelectric printheads. The thermal printheads 70–76 typically include a plurality of resistors which are associated with the nozzles. Upon energizing a selected resistor, a bubble of gas is formed which ejects a droplet of ink from the nozzle and onto a sheet of paper in the print zone 25 under the nozzle. The printhead resistors are selectively energized in response to firing command control signals delivered by a multi-conductor strip 78 from the controller 45 to the printhead carriage 50.

Flexible Frame Onsert

Molded Capping System

Figure 3:
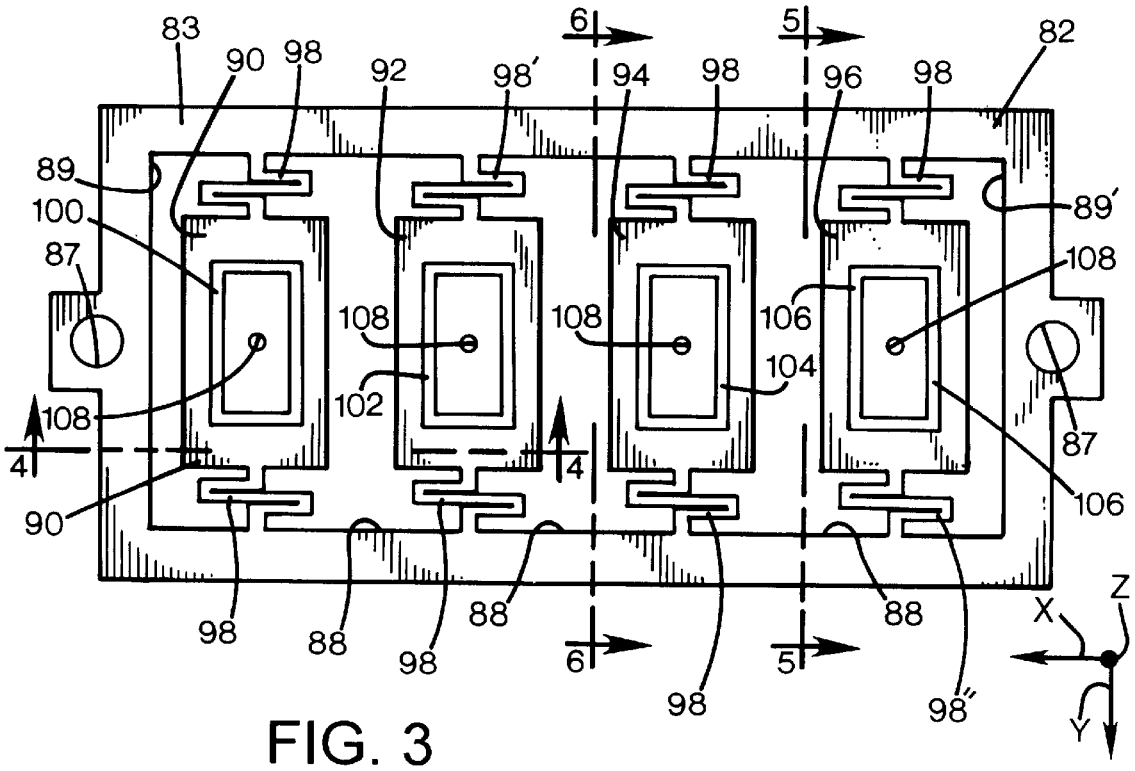
FIG. 3 is a top plan view of the view of capping assembly of FIG. 2, with the sled omitted for clarity.

FIGS. 2 and 3 illustrate one form of a flexible frame onsert molded capping system 80 constructed in accordance with the present invention for sealing the printheads 70–76 of pens 60–66. In the illustrated embodiment, the flexible capping system 80 includes a flexible frame 82 that has an outer border portion 83 which is received within slots 84 of a capping sled portion 85. To secure the frame 82 to the sled 85, two fasteners, such as rivets or self-tapping screws 86, are inserted into a pair of holes (not shown) in sled 85, with the fasteners also engaging a pair of holes 87 defined by the frame border 83. While a screw and slot arrangement is shown to attach the frame 82 to sled 85, it is apparent that a variety of other attachment means may be used to secure the frame 82 to the sled. For example, rather than sliding the frame 82 into slots 84, each slot 84 may be closed at each end, with the frame 82 flexed for insertion into the slots 84.

The flexible frame 82 may be constructed of any type of plastic or metallic material having a spring characteristic that allows the frame to return to its natural, preferably flat, state after being stressed or bent into a position away from that natural state. The preferred material for the frame 82 is a stainless steel, such as ASTM 301 or 304 stainless steel, preferably full-hard and cold-rolled which provides a substantially constant spring-rate over the life of the frame 82. For instance, a frame 82 constructed of a metallic shim stock material, on the order of 0.508 millimeters (nominally 0.020 inches) thick, was found to perform suitably. A stainless steel is preferred because it has superior durability and resistance to corrosion, not only from the ink but also from other environmental factors, such as high humidity or rapid changes in temperature during transport. In addition to the 300-series stainless steel alloys, it is also believed that other alloys would be suitable, for example the 400-series of stainless alloys.

Conventional spring steels may also be suitable for frame 82, although they may need some surface preparation, such as a paint or other coating to protect them from corrosion due to environmental factors or from degradation caused by the ink itself. While various plastic materials were not tested, it is believed that plastics may also serve as suitable materials for the flexible frame 82. However, given the performance characteristics of the current commercially available plastics, metals are preferred because these plastics have a tendency to creep when stressed. "Creep" is a term used in the plastics industry to describe the failure of a plastic to return to its original shape after being stressed without losing any restoring force or spring rate. The metals proposed herein for frame 82 do not suffer creep failure. Moreover, preferably onsert molding techniques are used to manufacture the flexible frame capping assembly 80, and the use of a metal frame 82 allows for higher onsert molding temperatures. Such higher onsert molding temperatures are believed to promote better bonding of elastomers to the frame 82, as well as more complete curing or cross-linking of the elastomeric material. Higher molding temperatures also yield faster curing times, which in turn provides a shorter manufacturing cycle, with a resulting lower cost to manufacture the cap assembly 80. Indeed, if the cap sled 85 is of a plastic material, the frame 82 may be insert molded as an integral portion of the sled 85.

As described in the Background section above, the cap sled 85 may be moved into engagement with the printheads 72–76 in a variety of different manners known to those skilled in the art. For instance, the cap sled 85 may approach the printheads 70–76 translationally, rotationally, diagonally or though any combination of these motions, depending upon the type of sled movement mechanism employed. Several different movement mechanisms and sled arrangements are shown in U.S. Pat. Nos. 4,853,717; 5,103,244; 5,115,250; 5,155,497; 5,394,178; 5,440,331; and 5,455,609, all assigned to the present assignee, the Hewlett-Packard Company. Indeed, in other pen support mechanisms, it may be more practical to move the printheads 70–76 into contact with the flexible frame capping system 80, or to move both the printheads and the capping system 80 together into a printhead sealing position.

Inside the border 83, a series of intricately fashioned holes or recesses 88, 89 and 89' have been cut through frame 82 to define four cap bases 90, 92, 94 and 96 which lie under the respective printheads 70, 72, 74 and 76 during capping. At each end of the cap bases 90–96, the base is attached to the border 83 by a suspension spring element, such as an S-shaped spring member 98 defined by the holes 80, 89 and 89' formed through the frame 82. The holes 80, 89 and 89' may be formed by removing material from the frame 82, for example through laser removal techniques, etching, punching or stamping, or other methods known to those skilled in the art. The spring elements 98 may take a variety of different forms, as illustrated in the embodiments below. The configurations for springs 98 shown herein are by way of illustration only to describe the concepts of the present invention, and it is apparent that other spring configurations may also be used to implement these concepts.

Preferably four elastomeric sealing lips 100, 102, 104 and 106 are onsert molded onto each of the cap bases 90, 92, 94 and 96, respectively. The manner of onsert molding the cap lips 100–106 onto the bases 90–96 may be done in a variety of different manners known to those skilled in the art for bonding elastomeric materials to metals or plastics. For example, the flexible frame, here frame 82, may define a series of holes through the frame under the sealing lips 100–106 to allow the elastomer to seep through these holes, forming an anchoring pad 107 of the elastomer along an underside 109 of the frame 82, with two of these anchoring pads 107 being shown in FIG. 5. While anchoring pads 107 could be added to other drawing views, they have been omitted for clarity in illustrating other principles of the present invention. The material selected for the cap lips 100–106 may be any type of resilient, non-abrasive, elastomeric material, such as nitrile rubber, elastomeric silicone, ethylene polypropylene diene monomer (EPDM), or other comparable materials known in the art, but EPDM is preferred for its durability and sealing characteristics which endure through a printer's lifetime.

The upper surface of each of the cap sealing lips 100–106 forms a substantially hermetic seal when engaged against the respective printheads 70–76 to define a sealing chamber or cavity between each orifice plate, lip and cap base, which retards drying of the ink within the nozzles. The cap lips 100–106 are sized to surround the printhead nozzles and form a seal against the orifice plate, although in other embodiments it may be preferable to seal a larger portion of the printhead, which may be easily done by varying the size of the sealing lips to cover a larger area of the printheads 70–76. The configuration of the sealing edge of lips 100–106, which actually contacts the printheads 70–76, may take a variety of different forms, such as a single ridge lip, a multi-ridge lip, or some combination thereof. For instance, one suitable suspended lip configuration is shown in U.S. Pat. No. 5,448,270, assigned to the Hewlett-Packard Company, the present assignee. For simplicity, the illustrated embodiments show each of the cap lips 100–106 as terminating in a single ridge.

As mentioned in the Background section above, there are a variety of different methods for venting the sealing chamber when contacting the printheads 70–76 with lips 100–106 to relieve pressure and prevent pushing air into the orifices, which otherwise could deprime the pens. In the illustrated embodiment, each of the cap bases 90–96 has a vent aperture, such as a small vent hole 108, extending from the sealing chamber to a lower surface 109 of the frame 82, with adequate venting provided by adjusting the size of the vent hole 108. Another venting scheme which may be used with the capping assembly 80 is described below with respect to FIG. 8. Still another venting system that is easily incorporated the illustrated embodiments is a diaphragm cap design. In a diaphragm cap, as the sealing lips 100–106 are onsert molded onto the bases 90–96, a thin elastomeric bottom layer is also formed along the interior of each lip adjacent the base, so the lips and the bottom layer together form an elastomeric cup-like structure (see FIG. 9, where a bottom elastomeric layer 100' has an optional vent hole 108' extending therethrough). Such a thin bottom layer may act in combination with one or more vent holes 108 to provide the proper pressure relief to prevent depriming the printheads 70–76 during the capping operation. For example, the concepts of a diaphragm cap system are disclosed in U.S. Pat. No. 5,146,243, assigned to the Hewlett-Packard Company, the present assignee.

Now that the basic components of the flexible frame onsert capping system 80 have been described, the basic manner of operation and method of sealing printheads 70–76 will be discussed. To aid in explaining this operation, a Cartesian coordinate axis system, having positive XYZ coordinate axes oriented as shown in FIG. 1, will be used. Here, the positive X-axis extends to the left from the service station area 52 across the printzone 25, parallel with the scanning axis 51. The positive Y-axis is pointing outwardly from the front of the printer 20, in the direction which page 34 moves onto the output wings 36 upon completion of printing. The positive Z-axis extends upwardly from the surface upon which the printer 20 rests. This coordinate axis system is also shown in several of the other views to aid in this discussion.

While a variety of different embodiments of the spring elements are shown herein, such as springs 98, preferably each type of suspension spring accomplishes the function of having both cantilever characteristics and torsional characteristics. These cantilever and torsional characteristics of the suspension springs allow the cap bases 90–96 to flex and rotate at least a fraction of the base out of a reference plane 110, which is defined by an unflexed state of the frame border 83. This flexibility of the cap base 90 to pivot and tilt with respect to the reference plane 110 allows the bases to function as independent spring-suspended platforms, similar to the ability of a trampoline to flex with respect to its frame. The trampoline analogy breaks down somewhat because a trampoline platform stretches, whereas the illustrated bases 90–96 are substantially rigid to provide firm support for the cap lips 100–106. It is apparent that the bases 90–96 may be locally reinforced for increased stiffness without impacting the springs 98. For instance, the bases 90–96 may be stiffened by adding ribs or dimples through molding for a plastic frame, or through a stamping process for a metallic frame, or by onsert molding other stiffening materials to the base, such as a rigid plastic member.

FIG. 4 is an enlarged front elevational view of the pens 60, 62 having printheads 70, 72 which are tilted with respect to the X axis, shown in a greatly exaggerated fashion to illustrate the concepts of the flexible frame onsert molded system 80. For example, in FIG. 4 the cap base 90 is shown tilting to define a plane 112, whereas the cap base 92 is tilting, here in an arbitrary opposite direction, to define a plane 114. FIG. 4 shows an extreme case where the cap bases 90 and 92 are each tilted in opposite directions, although it is apparent that both bases also may be tilted in the same direction, either at the same angle or more likely, at different angles, with respect to the reference plane 110. This tilting is allowed by the torsional nature of the suspension springs, where spring 98 allows base 90 to be torqued in a counter-clockwise direction to align with printhead 70, and spring 98' allows base 92 to be torqued in a clockwise direction to align with printhead 72. Indeed, the tilt or twisting of base 90 defines an angle ΘY1 between the reference plane 110 and the plane 112. Similarly, another angle ΘY2 is defined by the intersection of the reference plane 110 and the plane 114 defined by the tilt of cap base 92. These angles ΘY1 and ΘY2 are referenced with respect to the Y-axis, because the cap bases 90 and 92 are shown rotated around longitudinal axes parallel with the Y-axis, and parallel to the illustrated arrangement of the nozzle arrays.

Note in FIG. 4, the cap lips 100 and 102 are slightly compressed more along the two outermost edges, which is due to the opposing directions of the tilt shown for the bases 90 and 92. The sealing lips 100, 102 are compressed in an uneven fashion to accommodate for some of the irregularities in the alignment of the printheads 70, 72 with respect to the reference plane 110. This uneven compression of the cap lips 100, 102 may be considered to be a micro-adjustment or compensation for sealing when the printheads 70, 72 are only slightly out of parallel with the reference plane 110. If the lips provide a micro-compensation, then the tilting of the cap bases 90, 92 may be considered as a macro-adjustment to compensate for major misalignment of the printheads 70, 72.

FIGS. 5 and 6 illustrate a cantilever function provided by the springs 98. In FIG. 5, printhead 76 of pen 66 is shown tilted downwardly to the right, which when oriented in the printer would be downwardly toward the front of the printer 20. In FIG. 5, the left spring element 98 is flexed upwardly from the border 83 in a cantilever action, whereas the opposite spring element 98" is flexed downwardly also in a cantilever action. As mentioned with respect to the sealing lips 100 and 102 in FIG. 4, here the sealing lip 106 is shown unevenly compressed, being compressed slightly more to the right in the view of FIG. 5 to accommodate for the misalignment of printhead 76 with respect to the reference plane 110. Here, the tilt of the base 96 defines a plane 116, which is offset from the reference plane 110 at an angle of ΘX1. This angle is labeled with respect to the X-axis because the cap base 96 is twisting around a lateral axis parallel with the X-axis, and perpendicular to the illustrated arrangement of the nozzle arrays.

In FIG. 6, printhead 74 of pen 64 is in the foreground being sealed by the cap lip 104, which is supported by the cap base 94. Here, the cap base 94 is tilted opposite to the direction of tilt for cap base 96 shown in FIG. 5, and also shown in the background in FIG. 6. Here, the tilt of the cap base 94 defines a plane 118, which is tilted with respect to the reference plane 110 at an angle of ΘX2. Note, while ΘX1 and ΘX2 represent tilting in opposing directions for the cap bases 94 and 96, it is apparent that the bases 94 and 96 may each tilt in the same direction for a given pair of printheads 74, 76. Moreover, the values of the angles ΘX1 and ΘX2 most likely will be different, rather than nearly equal as illustrated.

For the purposes of illustration, the angle of tilt for the cap bases 90 and 92 are shown around axes parallel to only the Y-axis, and the angles of tilt of bases 94 and 96 are shown as existing only around axes parallel to the X-axis, it is apparent that a much more realistic scenario would have some combination of tilt for a given printhead around both the X and Y-axes. Advantageously, the torsional features of the springs 98 illustrated in FIG. 4, and the cantilever features of the springs 98 shown in FIGS. 5 and 6 may be combined in the action of a single spring element. That is, the suspension springs 98 may be stressed in both cantilever and torsional fashions to allow skew rotation of the cap bases 90–96 with respect to the X and Y-axes defining the reference plane 110. Furthermore, since the border 83 is also of the same parent material as the springs 98 and bases 90–96, in some extreme cases portions of the border 83 may also flex and deviate from the reference plane 110 during capping, while returning to a rest configuration coplanar with the reference plane 110 when uncapped. In FIGS. 5 and 6 the spring 98 and 98" are shown as having a thinner cross sectional area than the border 83 and bases 90–96, which increases the flexibility of these springs. With a metallic frame 82, this thinner region may be easily obtained by machining away a portion of the springs, preferably from the lower surface 109 of the frame.

Before moving on, note that while FIGS. 4–6 show the pens 60, 62 being misaligned with respect to the carriage 50, these figures also represent the case where a printhead is not seated within the pen body at the proper angle. That is, if the bodies of pens 60, 62 were properly installed in carriage 50, the printheads 70, 72 may not have been assembled at the nominal location, but instead at one end of the acceptable tolerance variations which still allow the printheads to function well. The capping system 80 also accommodates these printhead variations through either the micro-compensation of the cap lips, or through the macro-compensation provided by the tilting of the cap bases.

This macro-compensation also accommodates height variations in the printheads 70–72. Indeed, beyond a poor seating of a pen in the carriage 50, or an accumulation of tolerance variations in the components, some off-axis printer designs purposefully introduce height variations between adjacent pens. For example, the carriage and pens may be designed so the orifice plates are at different heights for different printhead-to-media spacings. For example, some designers find it preferable to locate the black orifice plate closer to the media during printing. The color orifice plates may then be at the level of the black orifice plate or up to 0.15 millimeters (6 mils; 0.006 inches) above this level. The flexing and articulation of each cap base independent of the other cap bases easily provides the macro-compensation to accommodate height variations in the printheads, including those variations which are designed into the printer 20.

Figure 7:
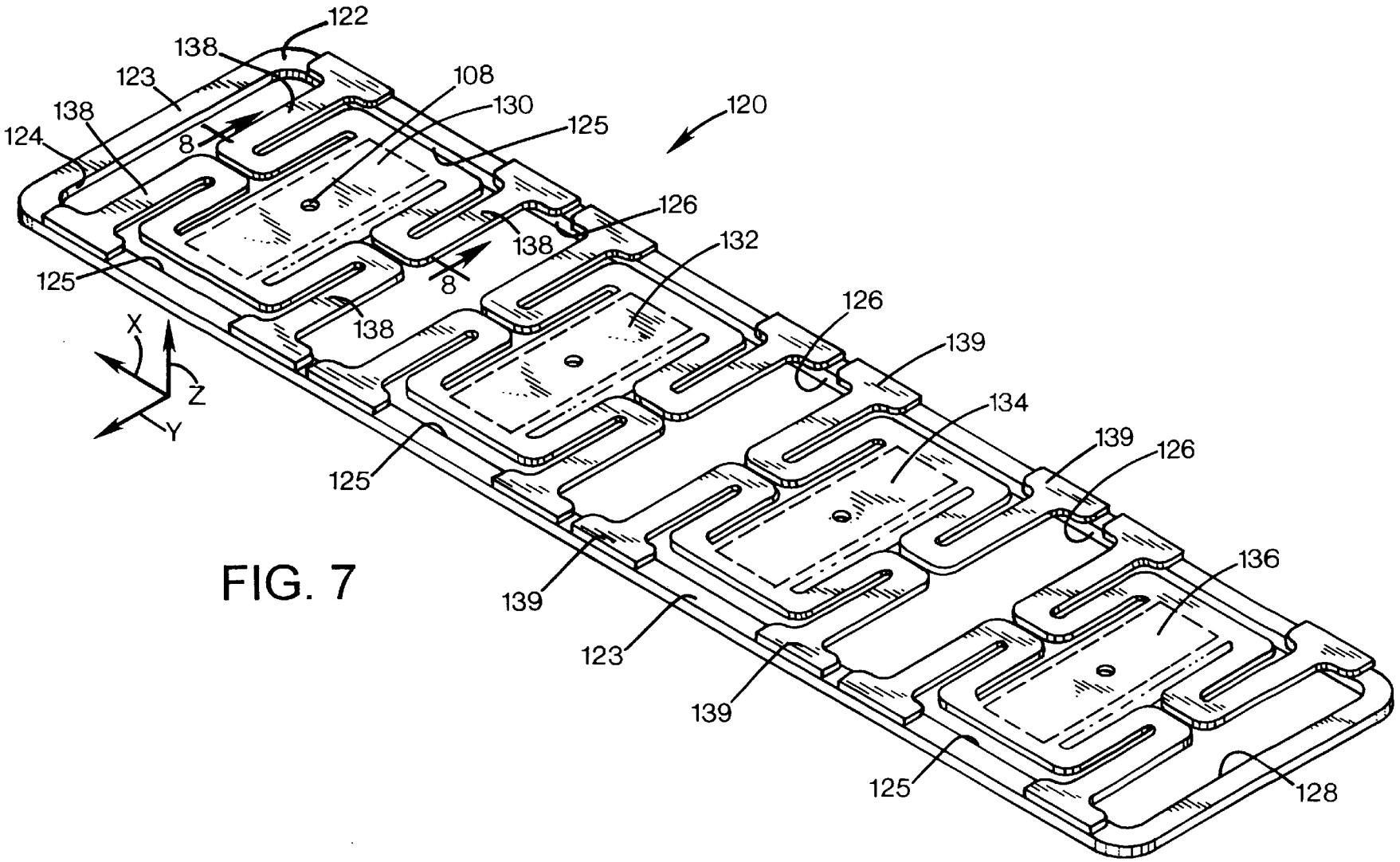
FIG. 7 is a top plan view of the view of a second alternate embodiment of a flexible onsert molded capping assembly of the present invention.

FIG. 7 shows a top view of a second flexible frame onsert molded capping system 120 having a frame 122, constructed in accordance with the present invention. The frame 122 may be constructed of the same materials as described above for frame 82, and then mounted to cap sled 85 or some other cap sled, also as described above. In the remainder of the embodiments described herein, these same comments apply to each capping system regarding the lip and frame materials, as well as the manner of construction and support, as described for frame 82 above unless noted otherwise. Similarly, the manner of venting in the sealing cavity may be applied to the other embodiments described herein, unless otherwise noted. Indeed, for clarity in FIG. 7, the cap lips 100–106 have been omitted from the view, along with any lip anchoring holes through the cap bases.

Figure 8:
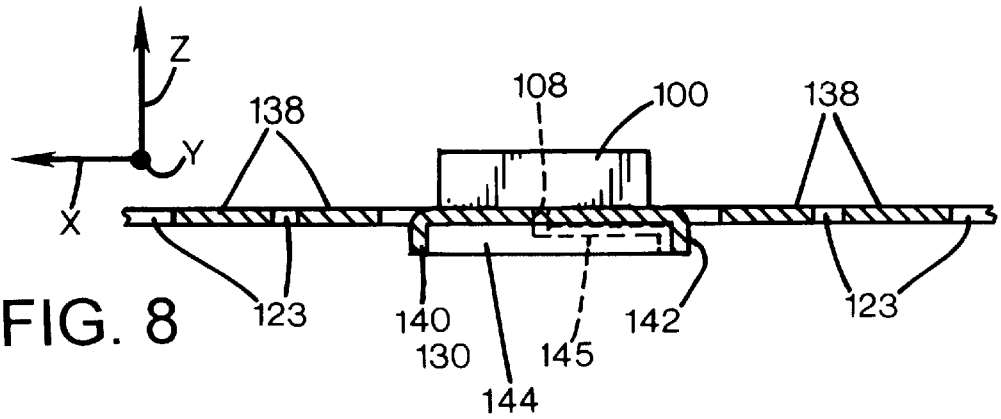
FIG. 8 is an enlarged, side elevational, sectional view taken along line 8—8 of FIG. 7, showing one manner of stiffening the cap frame.

Referring to FIGS. 7 and 8, here the frame 122 defines a border portion 123. The border 123 may in part define a series of cut-out regions 124, 125, 126 and 128 where material has been removed from the frame 122, for example through methods described above. The recesses 124–128 define a series cap basis 130, 132, 134 and 136 upon which the sealing lips 100, 102, 104 and 106 may be attached using onsert molding techniques. Each of the cap bases 130–136 is suspended from the frame border 123 by four C-shaped suspension spring elements 138. In this system, the springs 138 consume space in the region beside each of the cap bases 130–136, which provides frame 122 with a slightly wider X-dimension and a slightly narrower Y-dimension than illustrated above for frame 82.

While the frame 122 may be formed from a single sheet of material, shim stock for instance, the frame illustrated in FIG. 7 is constructed from five separate pieces, including the border 123 and four identical base segments each including a base and four adjoining spring elements 138. As shown for base 134, each spring element 138 terminates in a mounting pad 139 which is attached to the border 123, for instance, using spot welding techniques. It is apparent that a similar modular construction technique may be employed in constructing several of the other capping systems illustrated herein. For example, this modular technique may be particularly useful where some printer models have only one or two printheads, while other models have three, four or more printheads.

FIG. 8 shows a cross sectional view of the first cap base 130 with sealing lip 100 onsert molded on the base. In some embodiments, it may be desirable to stiffen the base 130, which may be easily done by bending down the side edges of the base beyond the outer edges of the sealing lip 100 to form a pair of flanges 140 and 142. For example, if the bases 130–136 were formed in a punching operation, it would be relatively easy to set up a separate stage of the punching operation to bend the flanges 140, 142 downwardly. Indeed, the flanges 140, 142 may define a location where a vent plug 144 may be secured, for instance if a vent hole 108 was punched through each cap base 130–136. Preferably, the vent plug 144 is of a ink-phyllic, resilient elastomeric compound, such as of a Santoprene® rubber sold by Monsanto Company, Inc., or other equivalent materials known to those skilled in the art.

The vent plug 144 may be attached to the lower surface 109 of the frame 82, for instance by wedging the plug between the flanges 140 and 142. The plug 144 may have a trough formed therein, so that when installed as shown in FIG. 8, this trough defines a vent tunnel 145 that provides a passageway between the vent hole 108 and atmosphere. Preferably, the vent tunnel 145 has a long and narrow configuration, with a small cross sectional area to prevent undue evaporation when he printhead is sealed, while also providing an air vent passageway during the initial sealing process. A variety of capillary passageway venting schemes are known to those skilled in the art, such as those shown in U.S. Pat. Nos. 5,027,134; 5,216,449; and 5,517,220, all assigned to the present assignee, the Hewlett-Packard Company. The vent plug 144 may be similarly attached to the other frame base designs illustrated herein, such as bases 90–96, by forming flanges 140, 142 to receive the plug 144. Alternatively, the capping sled 85 may be formed to receive the vent plugs 144, as long as the plug material is soft enough and easily compressible to allow for the degrees of base flexure illustrated in FIGS. 4–6.

Figure 9:
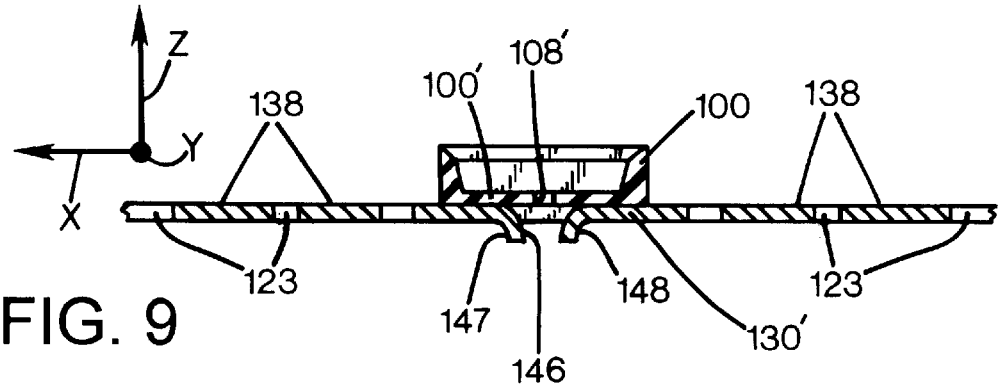
FIG. 9 is an enlarged, side elevational, sectional view taken along line 8—8 of FIG. 7, showing an alternate manner of stiffening the cap frame.

FIG. 9 shows an alternate stiffening method for cap base 130', which may also be combined with the venting process. In FIG. 9, the cap base 130', which is an alternative embodiment for bases 130–136, has a vent hole 146 punched therethrough, with lips 147 and 148 extending downwardly along the hole 146. Indeed, the vent hole 146 may be a slot running within the capping region defined by the cap lips 100. These flange stiffening concepts shown in FIGS. 8 and 9 may also be employed with frame 82, by turning down the outer edges of cap bases 90–96 as shown in FIG. 8, or by punching a slot through the bases as shown in FIG. 9.

Such a slot configuration for the vent hole 146 may be used in conjunction with a diaphragm pressure relief system, for instance of the type shown in U.S. Pat. No. 5,146,243, also assigned to the present assignee, Hewlett-Packard Company. As shown in FIG. 9, the sealing lip 100 has been onsert molded to the base 130' with a thin elastomeric bottom layer 100' which together with the upright lips forms an elastomeric cup-like structure. The bottom elastomeric layer 100' is shown in FIG. 9 with an optional vent hole 108'. Alternatively, without the vent hole 108', the bottom layer 100' may flex downwardly into the slot 146 when contacting the orifice plate for capping, with this downward flexure expanding the size of the sealing cavity to prevent air from being forced into the nozzles.

Figure 10:
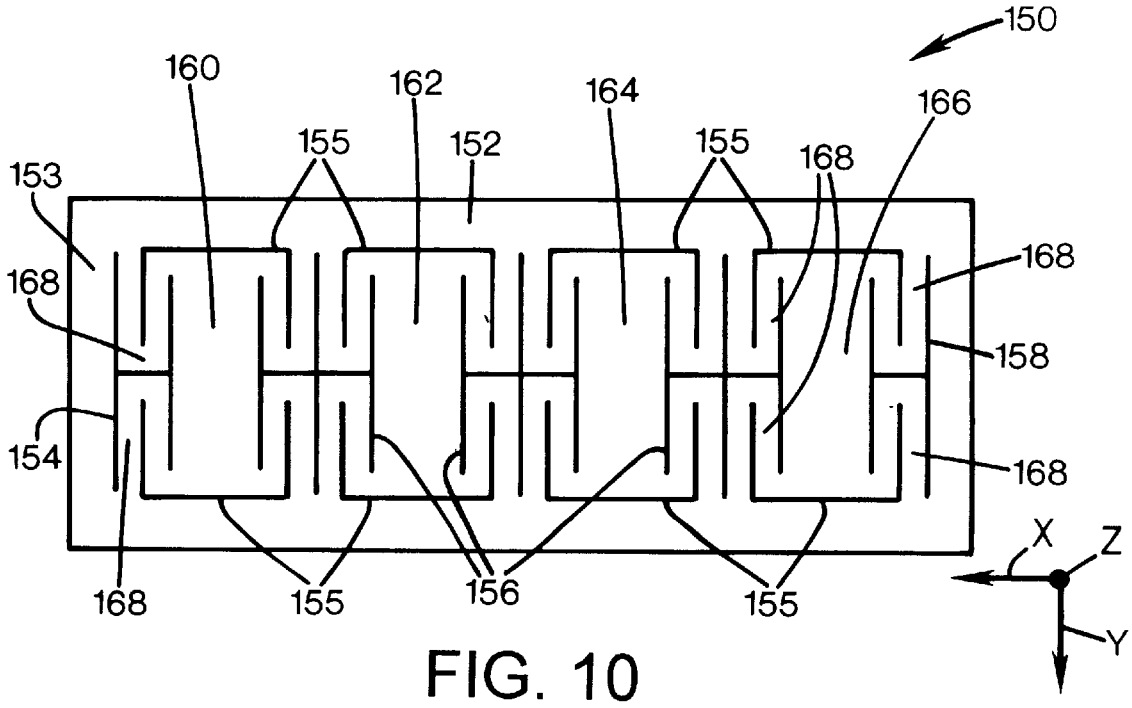
FIG. 10 is a top plan view of the view of a third alternate embodiment of a flexible onsert molded capping assembly of the present invention.

FIG. 10 shows a third embodiment of a flexible frame onsert capping system 150 constructed in accordance with the present invention as having a frame 152 with a border portion 153. The frame 152 defines a series of holes or slots which have been cut there through, including a single H-shaped slot 154, a series of eight U-shaped slots 155, three double H-shaped slots 156, and a second H-shaped slot 158.

The slots 154–158 are arranged to define four cap bases 160, 162, 164 and 166. Each of the cap bases 160–166 are attached to the border 153 by four C-shaped suspension spring elements 168, which are also defined by the location of the slots 154–158. For clarity, the cap lips 100–106 have been omitted from the view of FIG. 10, as well as any vent holes, such as holes 108 shown in FIG. 3, or the diaphragm 100' and slot venting of FIG. 9, although it is apparent that all of the venting schemes described above may also be applied to capping system 150. Moreover, reinforcing members, such as flanges 140, 142, 147 and 148 in FIGS. 8 and 9 may be also added to the cap bases 160–166 if stiffening should be desired.

Figure 11:
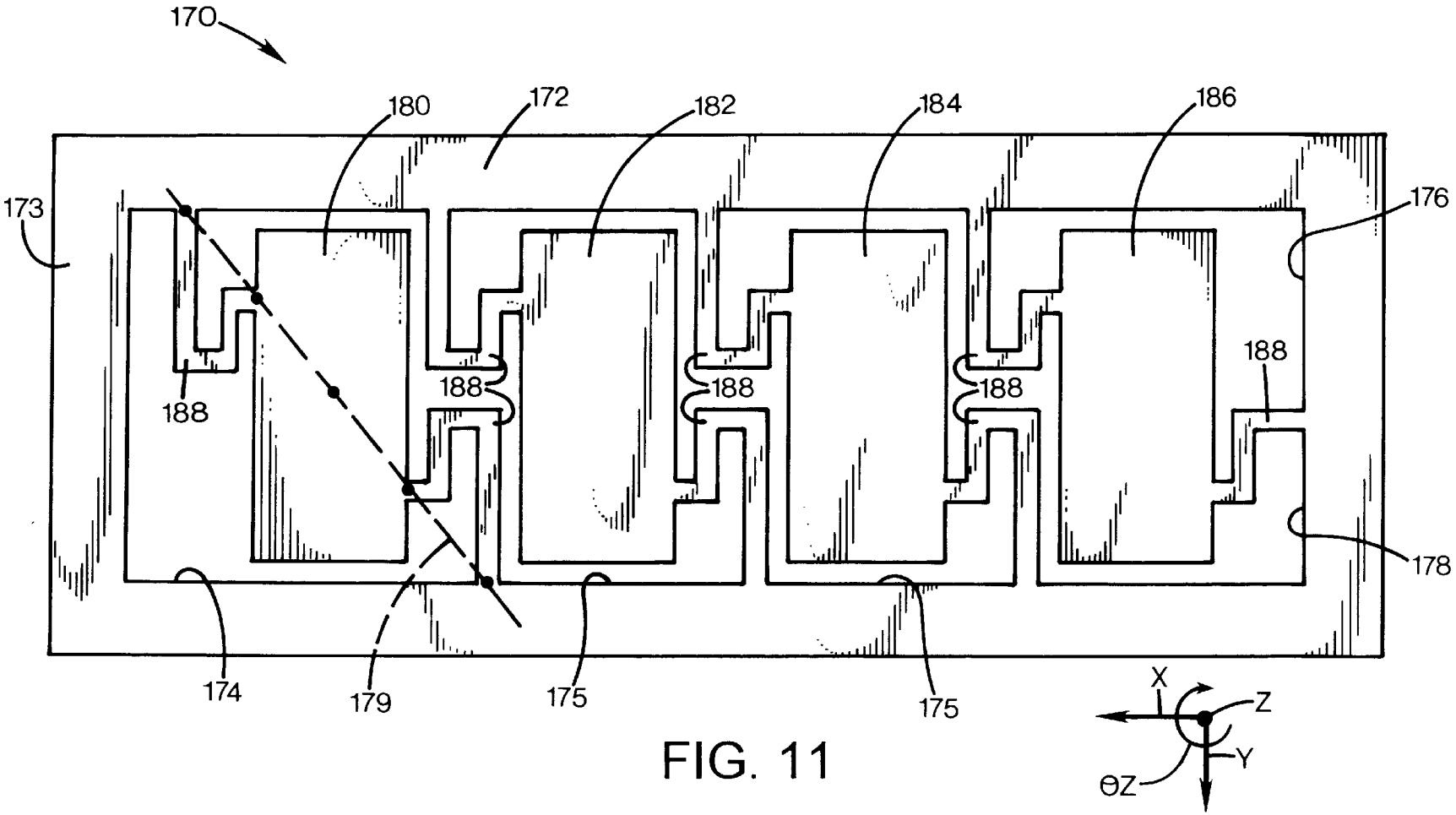
FIG. 11 is a top plan view of the view of a fourth alternate embodiment of a flexible onsert molded capping assembly of the present invention.

FIG. 11 illustrates a fourth embodiment of a flexible frame onsert molded capping system 170 constructed in accordance with the present invention as having a frame 172 with a border region 173. The frame 172 defines a series of holes which may have been cut out of the flat stock material from which frame 172 was made using any of the techniques described above. These holes include cut-outs 174, 175, 176 and 178 which together define four cap bases 180, 182, 184 and 186. Each of the cap bases 180–186 are attached to the border portion 173 by two suspension spring elements 188. For clarity, the sealing lips 100–106 and any vent holes 108 have been omitted from the view of FIG. 11, although they may be constructed as described above with respect to the capping system 80. Given the side attachment of the spring elements 188 to each of the cap bases 180–186, turning down the outer sides of the cap bases for stiffening as illustrated with respect to FIG. 8 may not be as practical as turning down the end regions, that is, those sides parallel with the X axis. However, the venting or stiffening slot 146 shown in FIG. 9 may be easily incorporated into the cap bases 180–186.

In FIG. 11, a straight line 179 is shown with five dots thereon, showing a preferred arrangement of attachment points for joining the spring elements 188 to each of the bases 180–186 and to the border 173. This straight line arrangement of the attachment points for springs 188 is believed to reduce ΘZ rotation of the cap bases 108–186 around the Z axis. Moreover, this arrangement of the attachment points for springs 188 along the straight line 179 is believed to be a structurally sound design, having both cantilever and torsional features which allow the tilting and twisting motions described with respect to FIGS. 4–6. Similarly, the same comment may be made for the suspension springs 138 and 168 shown in FIGS. 7 and 10, which also have both cantilever and torsional features to allow such tilting and twisting of the cap bases to provide tight seals against printheads 70–76.

Figure 12:
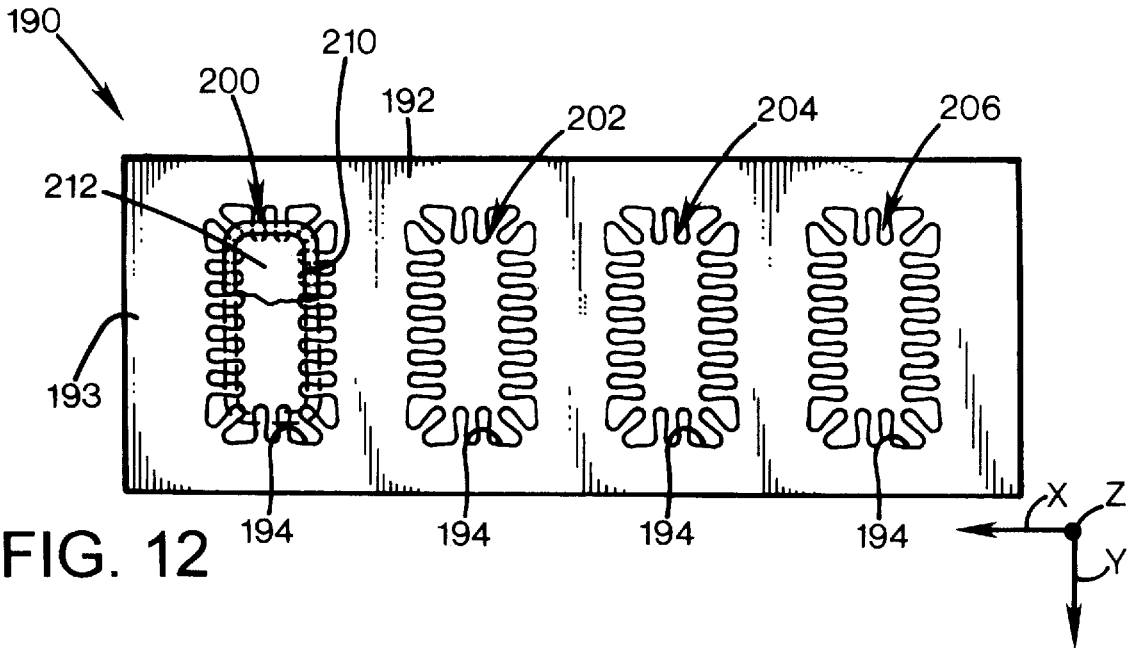
FIG. 12 is a top plan view of the view of a fifth alternate embodiment of a flexible frame of an onsert molded capping assembly of the present invention.
Figure 13:
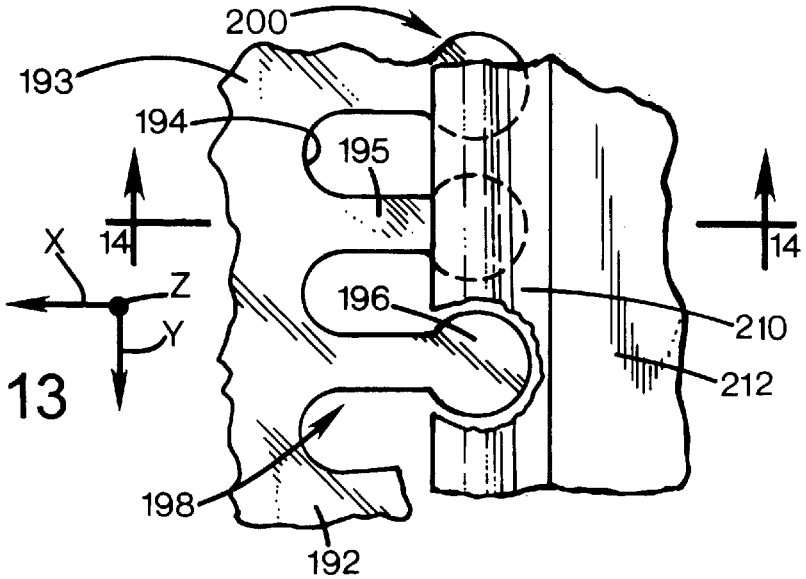
FIG. 13 is an enlarged top plan view of a portion of the capping assembly of FIG. 12, showing the location of the sealing lip with respect to the spring elements.
Figure 14:
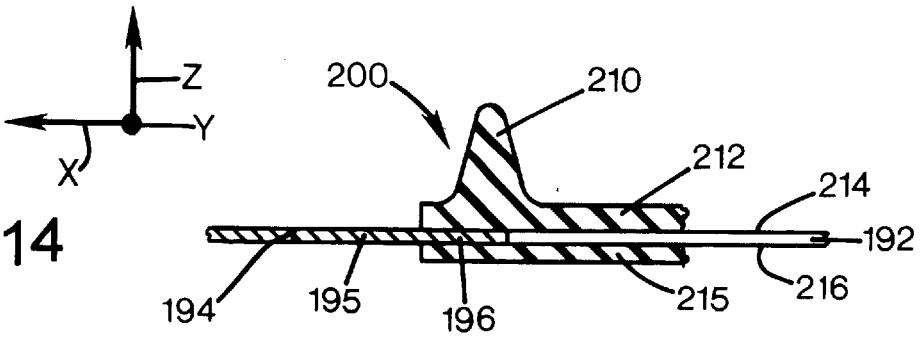
FIG. 14 is side elevational, sectional view taken along line 14—14 of FIG. 13.

FIGS. 12 through 14 illustrate a fifth embodiment of a flexible frame onsert capping system 190 constructed in accordance with the present invention and having a frame 192 which includes a border region 193. Here, the frame 192 defines a series of cut-out regions which have been removed, for instance by a punching or a laser operation, from a sheet of flat shim stock. The frame 192 defines four cut-out regions 194, a portion of which is shown in detail and enlarged in FIG. 13. The cut-out regions 194 preferably define a series of fingers 195, each optionally terminating in an enlarged pad region 196. Each finger 195 and pad 196 flex together to form a suspension spring element 198. Each of the spring elements 198 has the ability to flex and articulate independent from the motion of the other spring elements. This independent articulation of the finger springs 198 allows each cap to easily accommodate for any waviness in the orifice plate, as well as accommodating for printhead tilt and height variations. Thus, FIG. 12 shows four groups of the fingers 195, with each group of fingers defined by one of the four cut-out regions 194. The pads 196 and a portion of the fingers 195 of each group together define one of four cap bases 200, 202, 204 and 206. The cap sealing lips have been omitted for clarity from bases 202–206 in FIG. 12. The fingers 195 may extend further into the center of the cut-out region 194 than illustrated. Alternatively, the fingers 195 may be of alternating or varying lengths, for example with the fingers near the central region of cut-out 194 being longer than those in the end regions. In another variation, two or more adjacent fingers 195 may be joined together along their pad portions 196 to form a support bar, or a series of support bars which may be interspersed with finger spring elements 195.

FIG. 14 is an enlarged view of a portion of frame 192 adjacent cap base 200, with a cap sealing lip 210 shown onsert molded on base 200. Here, the sealing lip 210 is onsert molded onto the frame 192 with a bottom elastomeric portion creating a bottom wall 212 over an upper surface 214 of the frame 192, as shown in FIG. 15. FIG. 15 also shows a bottom layer or plug 215 attached to a lower surface 216 of the frame 192, and also attached in part to the cap bottom wall 212. The bottom plug 215 may be an elastomeric portion of the cap 210, or more preferably, a rigid member of a plastic material for instance, attached to the frame 192 by bonding or other means, such as during a portion of the onsert molding process. The use of the bottom layer 215 aids in gripping the fingers 195 and pads 196 during flexure of the springs 198 formed by the pads and fingers. The use of substantially rigid member for the bottom plug 215, along with the elastomeric bottom surface 212 of lip 210, aids in providing a flexible pressure relief diaphragm 212 vent system, to prevent depriming of the pens 60–66 when capping. It is apparent that cap lips similar to lip 210, along with a bottom plug 215, may also be installed along the cap bases 202, 204 and 206, as described here for base 200.

Conclusion

Thus, each of the flexible frame onsert capping systems 80, 120, 150, 170, 190 may be considered in the broadest sense to be comprised of a substantially rigid frame border 83, 123, 153, 173, 193, and at least one cap base 90–96, 130–136, 160–166, 180–186, 200–206, that supports a sealing lip 100–106 or 210–212. In this broad view, each capping system 80, 120, 150, 170, 190 also has a flexible web portion that couples the cap base to the frame border, with the illustrated flexible web portions comprising the spring elements associated with each cap base, including spring elements 98, 138, 168, 188 and 198. It is apparent that such a suspended flexible capping system may have the frame constructed of separate pieces for the border, the bases, and the flexible web or spring elements, but many of the economies associated with the illustrated single-piece frame structure may then not be realized. Furthermore, while the illustrated borders surround the cap bases, it is apparent that this is not necessary. For instance, in FIGS. 3 and 11, the borders 83 and 173 may be secured to a cap sled along the upper and lower legs of the borders, and the side legs, such as those housing holes 87 in FIG. 3, may be eliminated.

Each of the flexible frame onsert capping systems 80, 120, 150, 170 and 190 may be interchangeably used, although some designs may lend themselves better to certain implementations. For example, the frame 82 is designed with end mounts for the spring elements 98 to conserve on physical room expended in the X-direction, at the expenditure of increasing the printer depth in the Y-direction. In contrast, frames 122 (FIG. 7) and 172 (FIG. 11) use more room to the sides to support the cap bases than system 80 (FIG. 3). Indeed, if space may be expended in the X-direction, a variety of different configurations for the spring elements may be used to suspend the cap bases, and those shown herein are for purposes of illustration only. Furthermore, these capping systems may be readily retrofitted into many existing service station designs.

The features shared in common by each of these capping systems 80, 120, 150, 170 and 190, is their ability to flex to accommodate pen orifice plates which may not be absolutely coplanar, due to manufacturing tolerances within the printer 20, the carriage 50, or the pens 60–66 themselves. This ability to compensate for orifice plate irregularities extends not only to compression of the cap lips 100–106, 210 for micro-compensation of orifice plate roughness and waviness, as in the earlier designs discussed in the Background section above, but also extends to gross variations from the gimbaling action of each of the cap bases for macro-compensation to accommodate tilt and height variations. This gimbaling action employs cantilever and torsional forces to the spring elements 98, 138, 168, 188, 198, and more importantly, allows each of the cap bases to flex and move independently of the other cap bases of each frame. Additionally, the use of a flat sheet stock to form the frames 82, 122, 152, 172, 192 advantageously provides a flat surface in which to onsert mold the cap lips 100–106, 210. Thus, a better onsert seal with each frame is believed to be able to be formed at a more economical rate.

A further advantage of the flexible frame onsert capping systems 80, 120, 150, 170 and 190, is the ability to manufacture each of the frames from a single piece of stock, such as shim stock preferably of the stainless variety etc., as discussed above. Thus, each of these frames 82, 122, 152, 172, 192 may be manufactured in a simple punching operation, or through laser techniques which may be automated, or other methods known to those skilled in the art. Simple punching operations and automated laser techniques may be performed in a cost-effective manner to provide a more economical printer 20. Furthermore, the onsert molding techniques used to apply the sealing lips 100–106, 210 to the cap bases are techniques which are well known in the art, easy to implement and automate, and cost-effective. Thus, the capping systems 80, 120, 150, 170 and 190 described herein are more economical than the earlier systems, while also providing superior flexibility to seal mutually non-coplanar printheads. Moreover, although the illustrated onsert capping systems 80, 120, 150, 170 and 190 have been shown capping four discrete printheads 70–76, it is apparent that one, two or more printheads may be capped by such a system, including the case of a single silicon substrate having multiple sets of printhead nozzles formed therein.

Furthermore, the use of these flexible frame capping systems 80, 120, 150, 170 and 190 advantageously allows for fewer parts to be used to construct the printer, which not only decreases the overall component cost, but also provides a printer which is easier to assemble, so labor costs are decreased. It is apparent that for any given design, adjustments may need to be made in the length, width, and thickness of the spring elements 98, 138, 168, 188, 198, to provide the desired mechanical capping forces. For example, in FIGS. 5 and 6 the spring elements 98 and 98" are shown as being thinner than the remainder of the frame 82, which advantageously allows greater flexibility with less force being applied to the printheads. Selection of these various spring element parameters are within the level of those skilled in the art to achieve the desired range of capping force which adequately seals the printheads 70–76 without damage and without unseating the pens from their carriage alignment datums. Moreover, by providing all of the capping elements on a single frame 82, 122, 152, 172, 192, and ganging the bases together, a better seal is believed to be achieve across all of the pens 60–66.

By configuring all of the spring elements adjacent any given base to be colinear with the center of the cap base, cantilever deflection of the spring element will not cause any rotation of the cap base. That is, if only a cantilever downward force is required to seal a printhead, no torsional forces are imparted to the cap during sealing. Furthermore, the ability of each of the cap bases to flex and tilt in both the X and Y directions while being deflected downwardly in a negative Z-direction, prevents stress risers from occurring not only in the spring elements, but also from being imparted to the printheads 70–76. Furthermore, while the illustrated embodiments anticipate having the sealing lips 100–106, 210 seal only around the printhead nozzles themselves, a larger cap may be used in some implementations to seal a greater portion of the printhead. Thus, the capping systems described above provides individual hermetic sealing for each of the printheads 70–76, while maintaining tight positional tolerances against each printhead during sealing.

As a further advantage, at the end of the useful life of the printer 20, the capping assemblies 80, 120, 150, 170 and 190 may be easily recycled. For example, once removed from the sled 85, the sealing lips 100–106, 210 may be removed from the frames 82, 122, 152, 172, 192 for instance, by manually snapping off the elastomeric lips or by using abrasion techniques, such as a tumbling operation. If the frames 82, 122, 152, 172, 192 were of a metallic material, then the sealing lips 100–106, 210 may be physically removed from the frame by hand, through abrasive or tumbling techniques, or by incineration, such as during the process of reclaiming the metallic material of the frame. The illustrated capping systems lend themselves to a variety of other recycling processes, such as chemical or magnetic separation techniques after grinding the frames and caps down into small particles. As landfill space becomes more limited, these recycling considerations will continue to grow in importance to consumers, as well as to the inkjet printing industry.

We claim:

1. A capping system for sealing ink-ejecting nozzles of an inkjet printhead in an inkjet printing mechanism, comprising:

a sled;

a flexible frame supported by the sled for movement between a rest position and a sealing position, the flexible frame including a border portion, a cap base portion and a spring portion comprising a pair of spring elements which couple the base portion to the border portion; and a sealing lip onsert molded to the flexible frame cap base portion, with the sealing lip sized to surround and seal the printhead nozzles when the frame is in the sealing position;

wherein the frame border portion defines a reference plane, and the spring portion allows at least a fraction of the cap base portion to move out of the reference plane when the frame is in the sealing position.

2. A capping system according to claim 1 wherein the border portion, the base portion, and the spring portion are each partially separated from one another by plural voids defined by and extending through the frame.

3. A capping system according to claim 1 wherein the spring portion is bonded to the border portion.

4. A capping system according to claim 1 wherein the spring portion bends under a cantilever force when allowing said at least a fraction of the base portion to move out of the reference plane.

5. A capping system according to claim 1 wherein the spring portion twists under a torsional force when allowing said at least a fraction of the base portion to move out of the reference plane.

6. A capping system according to claim 1 wherein the spring portion bends under a cantilever force and twists under a torsional force when allowing said at least a fraction of the base portion to move out of the reference plane.

7. A capping system according to claim 1 wherein:

the sealing lip and the base portion and the printhead define a sealing chamber therebetween when the frame is in the sealing position; and the base portion defines a vent hole therethrough to couple the sealing chamber to atmosphere.

8. A capping system according to claim 7 wherein the base portion defines a vent hole therethrough comprising a vent slot.

9. A capping system according to claim 8 wherein the base portion includes a projecting flange that defines the vent slot.

10. A capping system according to claim 1 wherein each of the pair of spring elements comprises a C-shaped spring member.

11. A capping system according to claim 1 wherein the spring portion comprises four spring elements.

12. A capping system according to claim 11 wherein each of the four spring elements comprises a U-shaped spring member.

13. A capping system according to claim 1 wherein the cap base portion has a first thickness, and the spring portion has a second thickness different from said first thickness.

14. A capping system according to claim 13 wherein the second thickness of the spring portion is less than the first thickness of the cap base portion.

15. A capping system according to claim 1 wherein the flexible frame comprises plural cap base portions and plural spring portions, with each cap base portion associated with at least one of the plural spring portions to couple each cap base portion to the border portion.

16. A capping system according to claim 15 wherein:

a first one of the plural cap base portions tilts in a first plane out of the reference plane when the frame is in the sealing position; and a second one of the plural cap base portions tilts in a second plane out of the reference plane when the frame is in the sealing position, with the second plane being nonparallel to the first plane.

17. A capping system according to claim 1 wherein:

the border defines an interior portion of the flexible frame; and the flexible frame comprises plural cap base portions located side-by-side within the interior portion of the flexible frame, with any two adjacent cap base portions separated by a void defined therebetween.

18. A capping system according to claim 1 wherein the flexible frame comprises plural cap base portions and plural spring portions, with each cap base portion associated with at least one of the plural spring portions to couple each cap base portion to the border portion so each cap base portion tilts independently from the other cap base portions out of the reference plane when the frame is in the sealing position.

19. A capping system according to claim 1 wherein the flexible frame is of a metallic material and the sealing lip of an elastomer.

20. A capping system according to claim 19 wherein the flexible frame is of a metallic material comprising a stainless steel, and the sealing lip of an elastomer comprising ethylene polypropylene diene monomer ("EPDM").

21. A capping system for sealing ink-ejecting nozzles of an inkjet printhead in an inkjet printing mechanism, comprising:

a sled;

a flexible frame supported by the sled for movement between a rest position and a sealing position, the flexible frame including a border portion, a cap base portion and a spring portion which couples the base portion to the border portion; and a sealing lip onsert molded to the flexible frame cap base portion, with the sealing lip sized to surround and seal the printhead nozzles when the frame is in the sealing position;

wherein the frame border portion defines a reference plane, and the spring portion allows at least a fraction of the can base portion to move out of the reference plane when the frame is in the sealing position;

wherein the sealing lip projects from a first surface of the flexible frame toward the printhead nozzles; and wherein the cap base portion includes a flange that projects from a second surface of the flexible frame which is opposite said first surface.

22. A capping system according to claim 21 wherein the cap base portion includes a pair of flanges each projecting from the second surface of the flexible frame.

23. A capping system for sealing ink-ejecting nozzles of an inkjet printhead in an inkjet printing mechanism, comprising:

a sled;

a flexible frame supported by the sled for movement between a rest position and a sealing position, the flexible frame including a border portion, a cap base portion and a spring portion which couples the base portion to the border portion, wherein the flexible frame comprises plural cap base portions and plural spring portions, with each cap base portion associated with at least one of the plural spring portions to couple each cap base portion to the border portion; and a sealing lip onsert molded to the flexible frame cap base portion, with the sealing lip sized to surround and seal the printhead nozzles when the frame is in the sealing position;

wherein the frame border portion defines a reference plane, and the spring portion allows at least a fraction of the cap base portion to move out of the reference plane when the frame is in the sealing position;

wherein the border has first and second legs that define therebetween an interior portion of the flexible frame; and wherein the plural cap base portions are located side-by-side within the interior portion of the flexible frame, with each cap base portion coupled by a first associated spring portion to the border first leg and by a second associated spring portion to the border second leg.

24. A capping system according to claim 23 wherein:

each cap base portion has two opposing ends and two opposing sides;

the first associated spring portion is coupled to one of the two opposing ends of the cap base portion; and the second associated spring portion is coupled to the other of the two opposing ends of the cap base portion.

25. A capping system for sealing ink-ejecting nozzles of an inkjet printhead in an inkjet printing mechanism, comprising:

a sled;

a flexible frame supported by the sled for movement between a rest position and a sealing position, the flexible frame including a border portion, a cap base portion and a spring portion which couple the base portion to the border portion; and a sealing lip onsert molded to the flexible frame cap base portion, with the sealing lip sized to surround and seal the printhead nozzles when the frame is in the sealing position;

wherein the frame border portion defines a reference plane, and the spring portion allows at least a fraction of the cap base portion to move out of the reference plane when the frame is in the sealing position;

wherein the border defines an interior portion of the flexible frame;

wherein the flexible frame comprises plural cap base portions located side-by-side within the interior portion of the flexible frame; and wherein the flexible frame further comprises plural spring portions located within the interior portion of the flexible frame, with at least two of the plural spring portions also being located between two of the plural cap base portions.

26. A capping system for sealing ink-ejecting nozzles of an inkjet printhead in an inkjet printing mechanism, comprising:

a sled;

a flexible frame supported by the sled for movement between a rest position and a sealing position, the flexible frame including a border portion, a cap base portion and a spring portion which couple the base portion to the border portion; and a sealing lip onsert molded to the flexible frame cap base portion, with the sealing lip sized to surround and seal the printhead nozzles when the frame is in the sealing position;

wherein the frame border portion defines a reference plane, and the spring portion allows at least a fraction of the cap base portion to move out of the reference plane when the frame is in the sealing position;

wherein the border defines an interior portion of the flexible frame;

wherein the flexible frame comprises plural cap base portions located side-by-side within the interior portion of the flexible frame; and wherein the flexible frame further comprises plural spring portions located within the interior portion of the flexible frame at positions that are not between any two of the plural cap base portions.

27. A capping system for sealing ink-ejecting nozzles of an inkjet printhead in an inkjet printing mechanism, comprising:

a substantially rigid frame border portion;

a cap base portion;

a sealing lip supported by the cap base portion, wherein the sealing lip is onsert molded to the cap base portion; and a flexible web portion coupling the cap base portion to the frame border portion.

28. A capping system according to claim 27 wherein the cap base portion has a first thickness, and the flexible web portion has a second thickness different from said first thickness.

29. A capping system for sealing ink-ejecting nozzles of an inkjet printhead in an inkjet printing mechanism, comprising:

a sled;

a substantially rigid frame border portion;

a cap base portion;

a sealing lip supported by the cap base portion; and a flexible web portion coupling the cap base portion to the frame border portion;

wherein the frame border portion, the cap base portion, and the flexible web portion comprise a unitary structure, with the frame border portion defining a reference plane, with said unitary structure being supported by the sled for movement between a rest position and a sealing position, with the frame border portion defining a reference plane, with the flexible web portion allowing at least a fraction of the cap base portion to move out of the reference plane when sealing the ink-ejecting nozzles of said inkjet printhead.

30. A capping system for sealing ink-ejecting nozzles of an inkjet printhead in an inkjet printing mechanism, comprising:

a substantially rigid frame border portion;

a cap base portion;

a sealing lip supported by the cap base portion; and a flexible web portion coupling the cap base portion to the frame border portion;

wherein the sealing lip projects from a first surface of the cap base portion toward the printhead nozzles; and wherein the cap base portion includes at least one flange that projects from a second surface of the cap base portion which is opposite said first surface.

31. A capping system according to claim 30 wherein flexible web portion comprises at least two spring elements.

32. An inkjet printing mechanism, comprising:

an inkjet printhead having ink-ejecting nozzles;

a carriage which reciprocates the printhead through a printzone for printing and to a servicing region for printhead servicing; and a capping system in the servicing region for sealing the printhead nozzles during periods of inactivity, with the capping system including:

a sled;

a substantially rigid frame border portion;

a cap base portion;

a sealing lip supported by the cap base portion and sized to surround the printhead nozzles; and a flexible web portion coupling the cap base portion to the frame border portion;

wherein the frame border portion, the cap base portion, and the flexible web portion comprise a unitary structure, with the frame border portion defining a reference plane, with said unitary structure being supported by the sled for movement between a rest position and a sealing position, with the frame border portion defining a reference plane, with the flexible web portion allowing at least a fraction of the cap base portion to move out of the reference plane when sealing the printhead nozzles.

33. An inkjet printing mechanism according to claim 32 wherein flexible web portion comprises at least two spring elements.

34. An inkjet printing mechanism according to claim 32 wherein the sealing lip is onsert molded to the cap base portion.

35. An inkjet printing mechanism according to claim 32 wherein the cap base portion has a first thickness, and the flexible web portion has a second thickness different from said first thickness.

36. An inkjet printing mechanism according to claim 32 wherein:

the printing mechanism further includes plural inkjet printheads each having ink-ejecting nozzles;

the carriage reciprocates each of the plural printheads through the printzone and to the servicing region; and the capping system seals the nozzles of each of the plural printheads during periods of inactivity, and the capping system further includes:

plural cap base portions, each having a sealing lip supported thereby and sized to surround the nozzles of one of the plural printheads; and plural flexible web portions each coupling one of the plural cap base portions to the frame border portion.

37. An inkjet printing mechanism, comprising:

an inkjet printhead having ink-ejecting nozzles;

a carriage which reciprocates the printhead through a printzone for printing and to a servicing region for printhead servicing; and a capping system in the servicing region for sealing the printhead nozzles during periods of inactivity, with the capping system including:

a substantially rigid frame border portion;

a cap base portion;

a sealing lip supported by the cap base portion and sized to surround the printhead nozzles; and a flexible web portion coupling the cap base portion to the frame border portion;

wherein in the capping system, the frame border portion, the cap base portion, and the flexible web portion comprise a unitary frame of a metallic material; and the sealing lip is of an elastomeric material which is detached from the metallic material of the unitary frame to recycle the metallic material of the capping system frame.

38. A capping system for sealing ink-ejecting nozzles of an inkjet printhead in an inkjet printing mechanism, comprising:

a flexible frame stamped from a metallic material to define a border portion, a cap base portion and a spring portion of the flexible frame, with the spring portion coupling the base portion to the border portion; and a sealing lip onsert molded to the flexible frame cap base portion and sized to surround and seal the printhead nozzles.

39. A capping system according to claim 38 wherein the flexible frame is stamped to define plural voids extending through the frame, with the plural voids serving to define the base portion and the spring portion.

40. A capping system according to claim 39 wherein the plural voids comprise a pair of U-shaped slots and a pair of H-shaped slots.

41. A capping system according to claim 38 wherein the flexible frame is stamped to define plural voids extending through the frame, with the plural voids serving to define the border portion which surrounds the base portion and the spring portion.

42. A capping system according to claim 38 herein:

the sealing lip projects from a first surface of the cap base portion; and the flexible frame is stamped to form a flange portion of the cap base portion, with the flange portion projecting from a second surface of the cap base portion which is opposite said first surface.

43. A capping system according to claim 38 wherein the flexible frame is stamped to define a vent aperture extending through the cap base portion.

44. A capping system according to claim 38 the flexible frame is stamped to define the spring portion as comprising a pair of spring elements.

45. A capping system according to claim 38 wherein the flexible frame is stamped to define the spring portion as comprising at least two S-shaped spring elements.

46. A capping system according to claim 38 wherein the flexible frame is stamped to define the spring portion as comprising at least two C-shaped spring elements.

47. A capping system according to claim 38 wherein the flexible frame is stamped to define the spring portion as comprising four U-shaped spring elements.

48. A capping system according to claim 38 wherein the flexible frame is stamped to define a central void surrounded by the border portion and to define the spring portion as including plural spring elements each comprising a flexible finger member extending into the central void.

49. A capping system according to claim 48 wherein the flexible frame is stamped to define each flexible finger member having a first width and extending from the border portion to terminate at a distal end comprising a pad portion having a second width greater than the first width.

50. A capping system according to claim 38 wherein:

the flexible frame has opposing first and second surfaces;

the cap base portion has a first thickness; and a portion of the metallic material of the flexible frame is removed by machining from at least the first surface at the spring portion, so the spring portion has a second thickness less than said first thickness.

51. A capping system according to claim 38 for sealing ink-ejecting nozzles of plural printheads of an inkjet printing mechanism, wherein:

the flexible frame is stamped to define plural cap base portions and plural spring portions that couple the plural cap base portions to the border portion; and the capping system further includes plural sealing lips each onsert molded to an associated one of the plural cap base portions, with each of the plural lips sized to surround and seal the nozzles of an associated one of the plural printheads.

52. A capping system for sealing ink-ejecting nozzles of an inkjet printhead in an inkjet printing mechanism, comprising:

a flexible frame of a metallic material having plural voids laser-cut therethrough to define a border portion, a cap base portion and a spring portion of the flexible frame, with the spring portion coupling the base portion to the border portion; and a sealing lip onsert molded to the flexible frame cap base portion and sized to surround and seal the printhead nozzles.

53. A capping system according to claim 52 wherein the plural voids comprise a pair of U-shaped slots and a pair of H-shaped slots.

54. A capping system according to claim 52 wherein the flexible frame is laser-cut to define the spring portion as comprising at least two S-shaped spring elements.

55. A capping system according to claim 52 wherein the flexible frame is laser-cut to define the spring portion as comprising at least two C-shaped spring elements.

56. A capping system according to claim 52 wherein the flexible frame is laser-cut to define the spring portion as comprising four U-shaped spring elements.

57. A capping system according to claim 52 wherein the flexible frame is laser-cut to define a central void surrounded by the border portion and to define the spring portion as including plural spring elements each comprising a flexible finger member extending into the central void.

58. A capping system according to claim 57 wherein the flexible frame is laser-cut to define each flexible finger member having a first width and extending from the border portion to terminate at a distal end comprising a pad portion having a second width greater than the first width.

59. A capping system according to claim 52 wherein:

the sealing lip projects from a first surface of the cap base portion; and after the flexible frame has been laser-cut, the flexible frame is stamped to form a flange portion of the cap base portion, with the flange portion projecting from a second surface of the cap base portion which is opposite said first surface.

60. A method of sealing ink-ejecting nozzles of plural inkjet printheads in an inkjet printing mechanism, comprising the steps of:

providing a capping assembly comprising a flexible frame having a border portion that defines a reference plane, and plural cap bases each associated with a respective one of the plural inkjet printheads, with the flexible frame also having suspension springs that couple each cap base to the border portion, with each cap base also supporting a sealing lip sized to surround and seal the nozzles of said associated printhead;

through relative movement of the plural inkjet printheads and the capping assembly, contacting each sealing lip and associated printhead; and during the contacting step, moving at least one of the plural cap bases away from an orientation parallel with the reference plane.

61. A method according to claim 60 wherein the moving step comprises the step of twisting said at least one cap base with respect to the reference plane.

62. A method according to claim 60 wherein the moving step comprises the step of tilting said at least one cap base with respect to the reference plane.

63. A method according to claim 60 wherein the moving step comprises the step of bending said suspension springs with a cantilever force.

64. A method according to claim 60 wherein the moving step comprises the step of twisting said suspension springs with a torsional force.

65. A method according to claim 60 wherein:

the moving step comprises the steps of bending said suspension springs with a cantilever force and twisting said suspension springs with a torsional force; and said cantilever and torsional forces are applied by the associated printhead contacting the sealing lip.

* * * * *

UNITED STATES PATENT AND TRADEMARK OFFICE

CERTIFICATE OF CORRECTION

PATENT NO : 5,936,647

DATED : August 10, 1999

INVENTOR(S) : Rhodes et al.

It is certified that error appears in the above-identified patent and that said Letters Patent is hereby corrected as shown below:

Column 2, (line 63), after "accomodating" delete "a".
Column 6, (line 32), after "Fig. 14 is" insert --a--.
Column 8, (line 8), delete "from" and insert therefor --form--.
Column 14, (line 23), delete "he" and insert therefor --the--.
Column 18, (line 6), delete "achieve" and insert therefor --achieved--.

Column 23, (line 67), delete "herein" and insert therefor --wherein--.
Column 24, (line 10), after "claim 38" insert --wherein--.

Signed and Sealed this

Eighteenth Day of April, 2000

*Attest:*

Q. TODD DICKINSON

*Attesting Officer*

*Director of Patents and Trademarks*